US006487729B2

(12) United States Patent
Delanzo

(10) Patent No.: US 6,487,729 B2
(45) Date of Patent: Dec. 3, 2002

(54) HAIR TRAP FOR DRAINS AND SINKS

(76) Inventor: Michael Delanzo, 1359 Knoll Dr., Oceanside, CA (US) 92054

( * ) Notice: Subject to any disclaimer, the term of this patent is extended or adjusted under 35 U.S.C. 154(b) by 27 days.

(21) Appl. No.: 09/826,151

(22) Filed: Apr. 5, 2001

(65) Prior Publication Data

US 2002/0144338 A1 Oct. 10, 2002

(51) Int. Cl.[7] ..... A47K 1/14
(52) U.S. Cl. ..... 4/286; 4/292
(58) Field of Search ..... 4/286–292

(56) References Cited

U.S. PATENT DOCUMENTS 313,068 A * 3/1885 Gage ..... 4/287
594,169 A * 11/1897 Catsiff ..... 4/287 X
938,607 A * 11/1909 Reed ..... 4/291
1,115,016 A * 10/1914 Pheils ..... 4/291 X
1,217,763 A * 2/1917 Hirrich ..... 4/DIG. 14 X
1,935,128 A * 11/1933 Pullman ..... 4/286
5,546,614 A * 8/1996 King, II ..... 4/292 X

* cited by examiner

*Primary Examiner*—Charles E. Phillips
(74) *Attorney, Agent, or Firm*—Steven W. Webb

(57) ABSTRACT

A helically-shaped hair trapping mechanism for drains is presented, which is a trapping mechanism that can be placed in a variety of drain sizes and shapes. The trap can be easily removed and cleaned or discarded and will fit in pop-up, plunger, or push-pull drains for showers, bathtubs, or sinks.

6 Claims, 9 Drawing Sheets

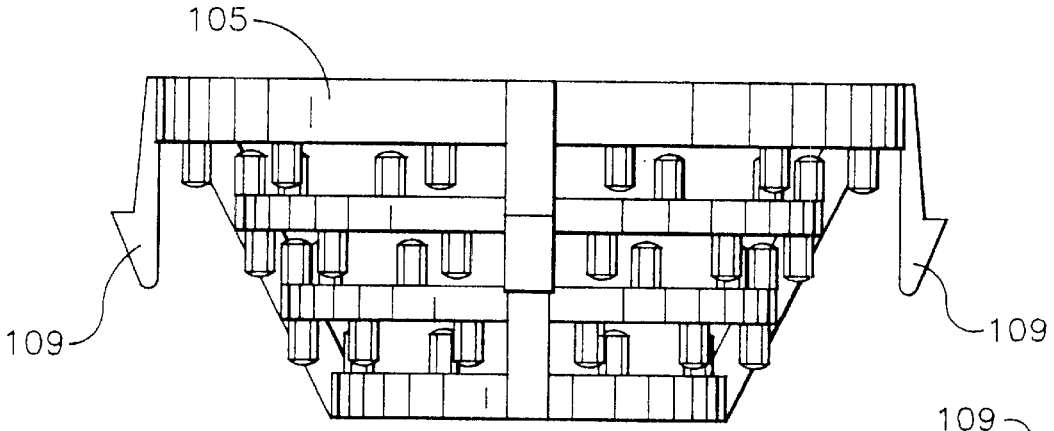
Fig. 3A
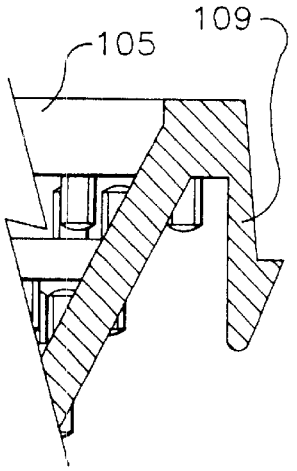
Fig. 3C
Fig. 3B
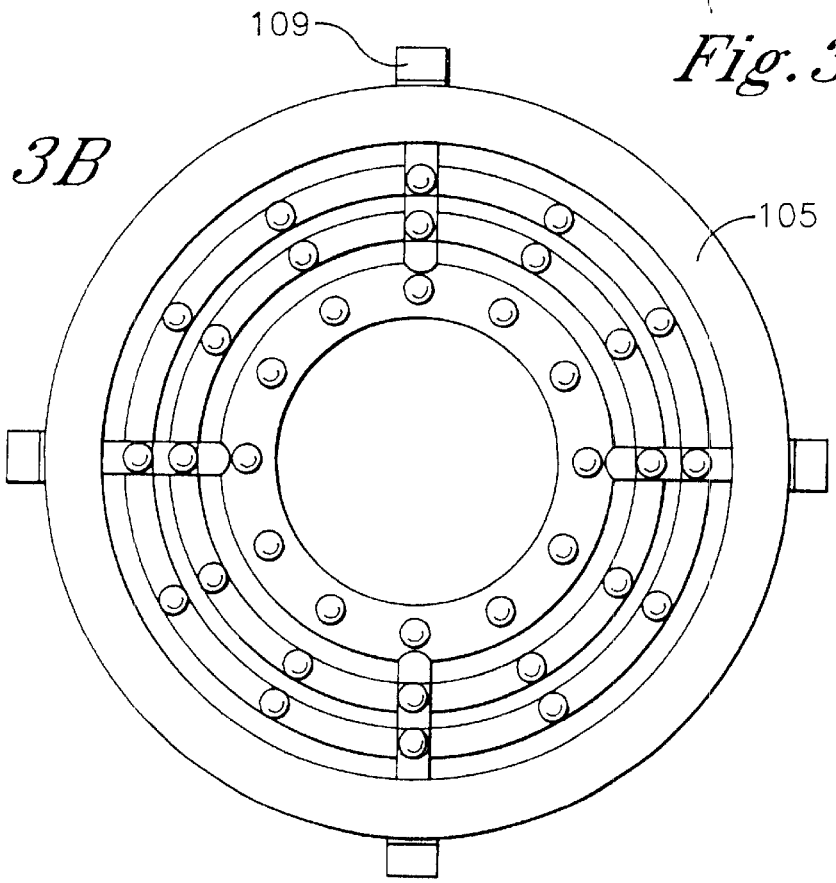

HAIR TRAP FOR DRAINS AND SINKS

BACKGROUND OF THE INVENTION

This invention relates to waste drain pipe filters and traps, and is usable with wash/bath tubs, shower drains, and sinks. The features of this invention are designed to stop, collect, and separate hair and other fibrous solid matter as it flows down a drain, rendering said fibrous matter collectable by drain maintenance personnel.

Existing hair traps and snares are placed above the drain opening, and are highly visible. This invention is placed in a concealed location within the plumbing openings, and the several embodiments are shaped specifically to fit each type of opening.

The prior art discloses various trap means for use with drain openings that trap solids while allowing liquids to flow freely by. These patents include U.S. Pat. Nos., 3,959,831, 4,207,631, 4,418,432, 4,539,718, and 4,825,477. Several patented devices fit within the standard U or gas-trap sections of pipe installed below drain openings, including U.S. Pat. No. 4,230,582.

Several of the above-listed patents separate solids from liquid flowing through drains, but none of them specifically target hair collection or are simple to install or remove. This invention differs from the above-listed devices by virtue of its ease of installation and removal and its improved ability to trap hair.

BRIEF SUMMARY OF THE INVENTION

It is an object of this invention to provide a concealed drain trap system that specifically collects hair and fibrous materials flowing down a drain, and by virtue of its design makes removal of said material and hair easy to accomplish.

It is a further object of this invention that trap system can be sized to fit various drain openings and not interrupt in the operation of the drain opening and closing mechanism, including pop-ups, plungers, and push and pull stoppers.

It is a further object of this invention that the trap mechanism be entirely concealed within the drain and retain the clean look of the drain fixture.

It is a further object of this invention that the trap system also be available in a more-easily manufactured form where the collection mechanism is a series of concentric circles.

Further objects of this invention can be discerned by perusing the detailed description, drawings, specifications and claims of this application.

BRIEF DESCRIPTION OF THE DRAWINGS

The construction and operation of the invention can be readily appreciated from inspection of the drawings that accompany this application, combined with the detailed specification to follow.

FIG. 3 is a blueprint drawing for the tub trap embodiment.

DETAILED DESCRIPTION OF THE INVENTION

Figure 1:
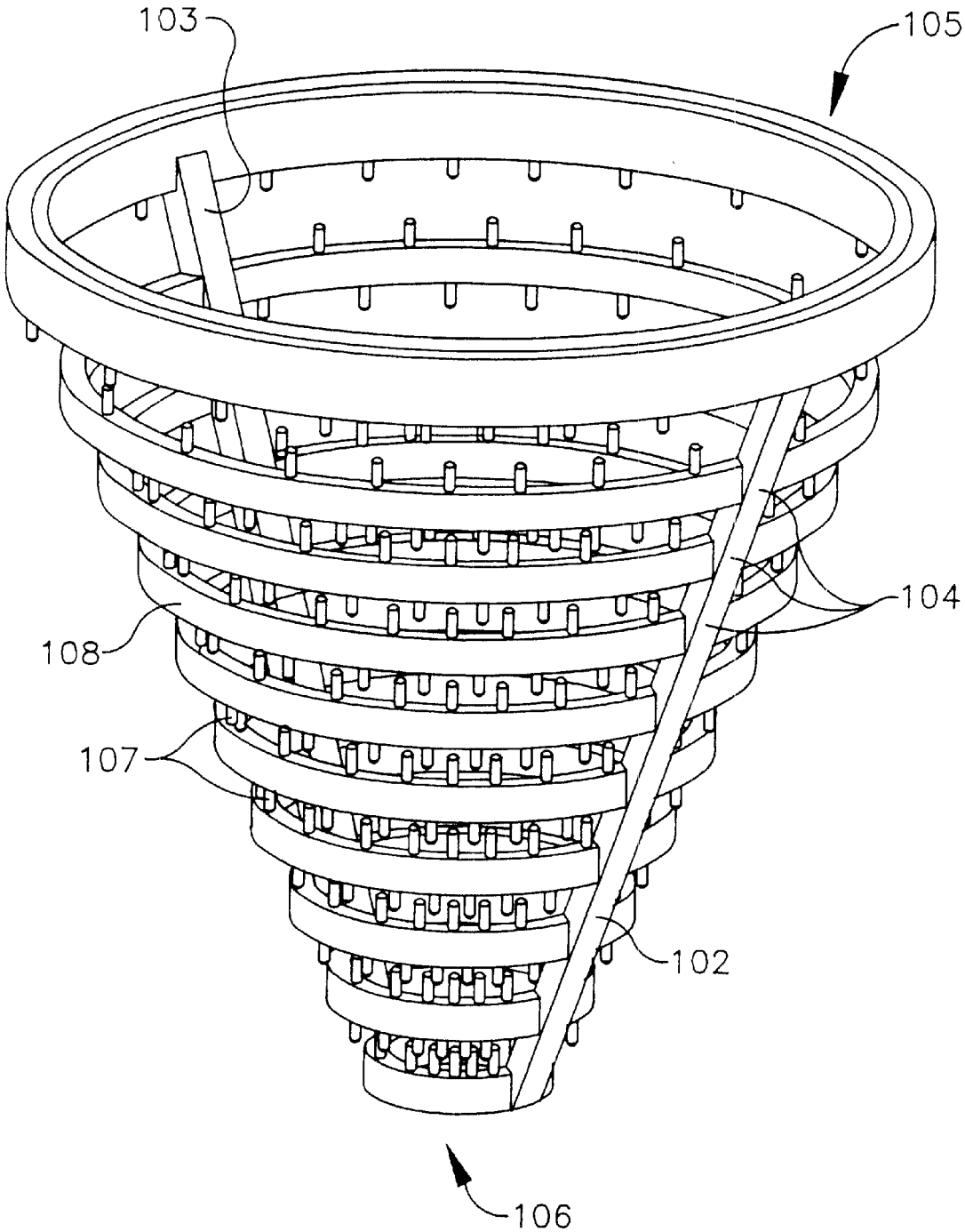
FIG. 1 is a perspective drawing of the preferred embodiment of the invention, called the shower trap.

The invention is best described by referring to the preferred embodiment illustrated in the drawings in FIG. 1.

Referring to FIG. 1, a shower trap 101 Is a basket-like structure, with a large top opening frame 105 and a smaller bottom opening frame at the bottom of the structure 106, with two support struts 102 and 103 connected to the structure at support points 104. The structure is a wire 108 with a rectangular cross-section, and the wire's surface possesses a rough texture. Attached to the wire's upper and lower surfaces are bullet-shaped barbs 107 which are angled from the surface of the wire so that the barbs are pointing towards the top and bottom opening frames 105, 106.

The separation distance between successive loops of the structure 108 Is small enough to prevent the passage of contact lenses or jewelry through the structure.

While the foregoing describes a preferred embodiment, variation on this design and equivalent designs may be resorted to in the scope and spirit of the claimed invention. Three particular additional embodiments are illustrated in the additional accompanying FIGS. 2 through 8.

Figure 2:
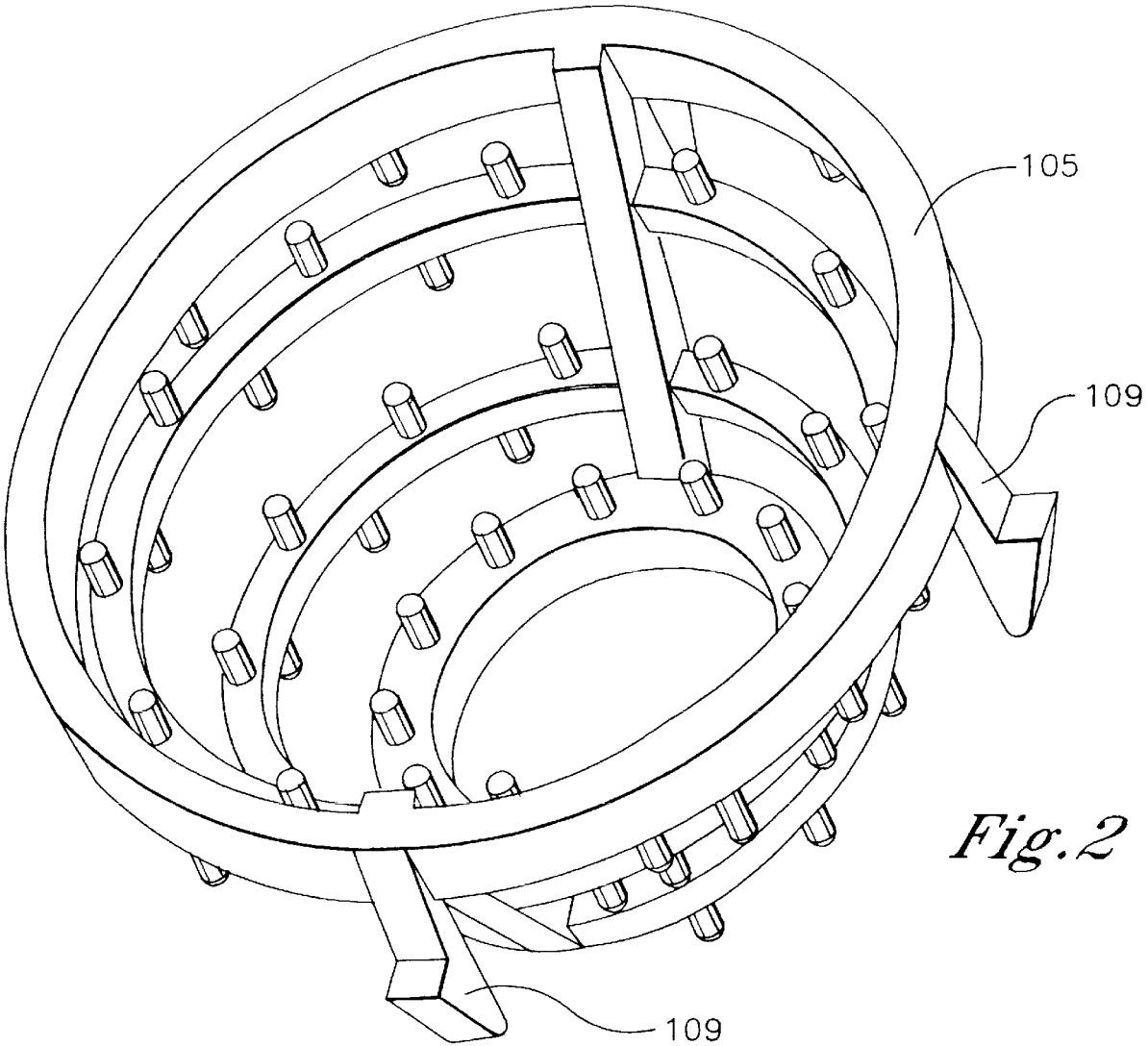
FIG. 2 is a combination drawing of a second embodiment for bathtubs called the tub trap.

The invention also includes an embodiment called the tub trap, shown in FIG. 2 and FIG. 3. In addition to the features of the shower trap, the tub trap possesses four adjusting stabilizers 109 fixedly attached to the top opening frame 105, designed to grab the edges of a tub drain opening. Instead of the concentric circular loops of the preferred shower trap embodiment, the tub trap is designed as a helical structure. The tub trap is squatter and wider in shape then the shower trap, but the essential features are the same.

Figure 4:
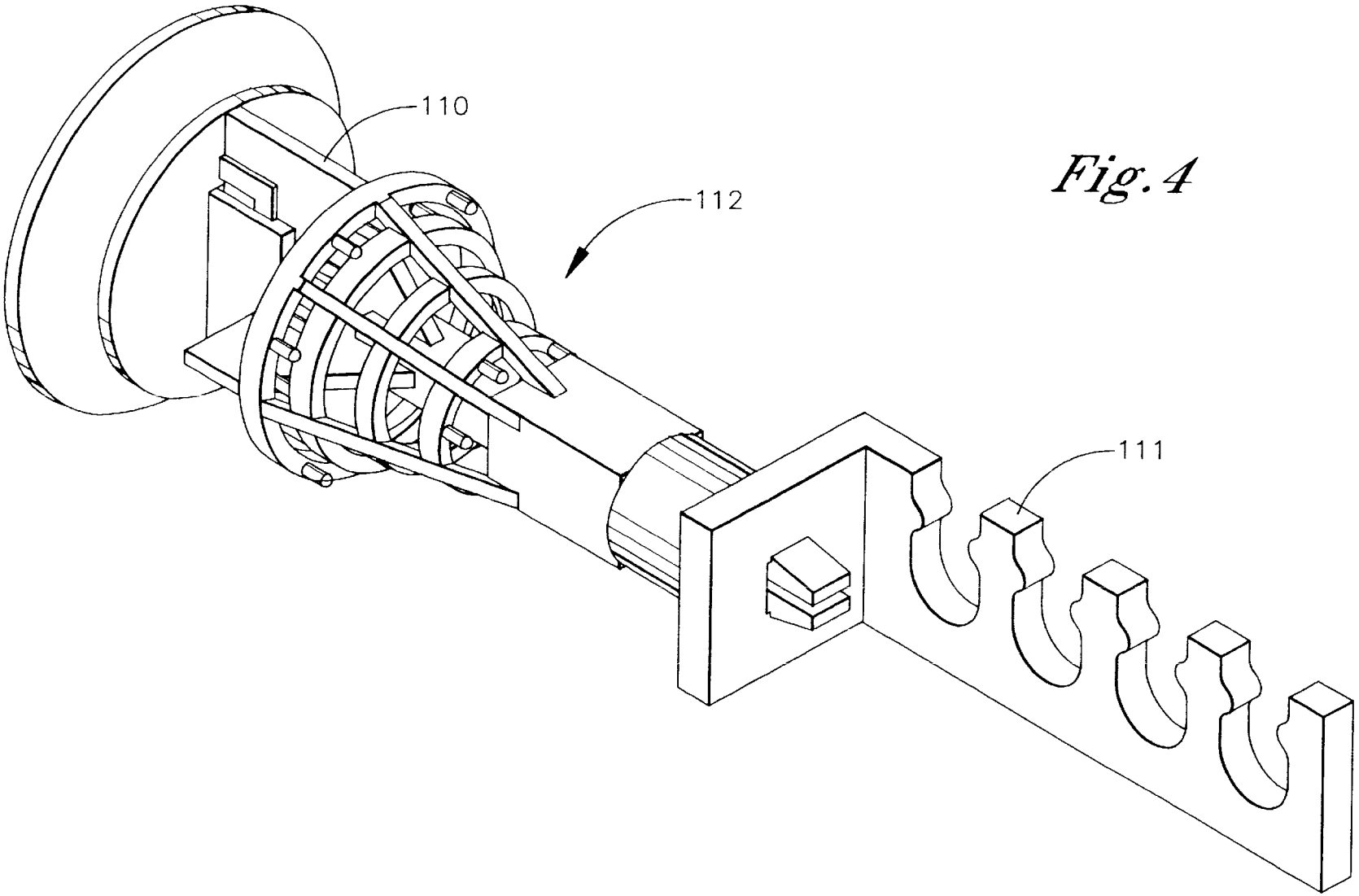
FIG. 4 is perspective drawing of the lavatory pop-up trap assembly.
Figure 5C:
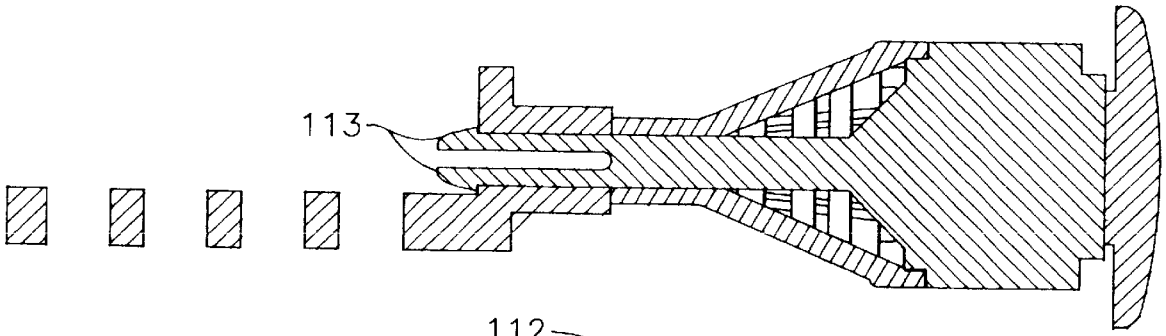
FIG. 5 is a blueprint drawing of the lavatory pop-up assembly.
Figure 5B:
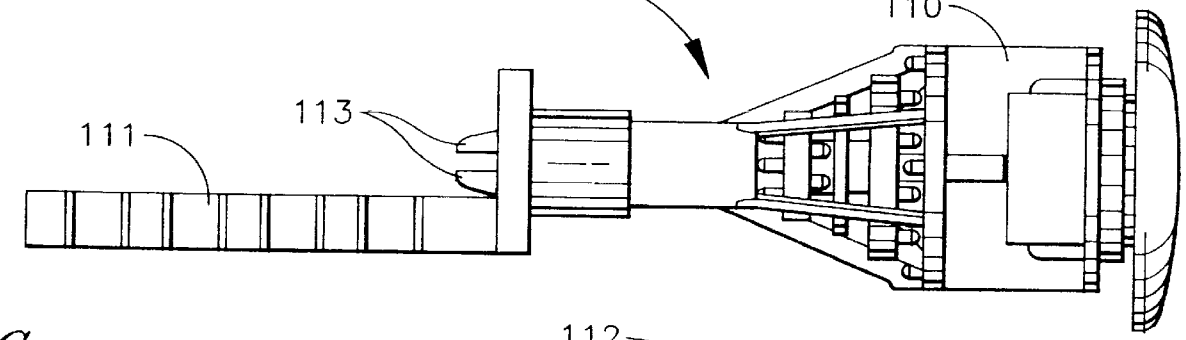
Figure 5A:
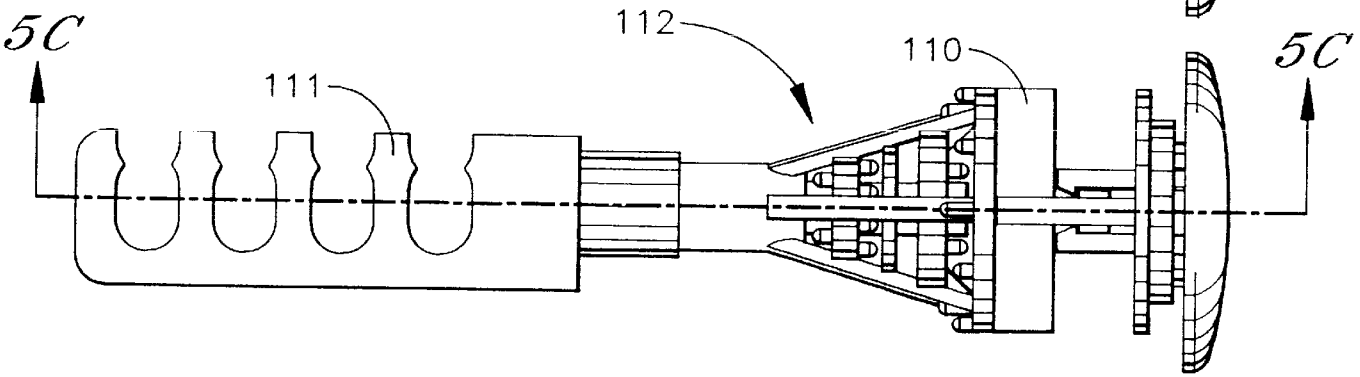
Figure 5D:
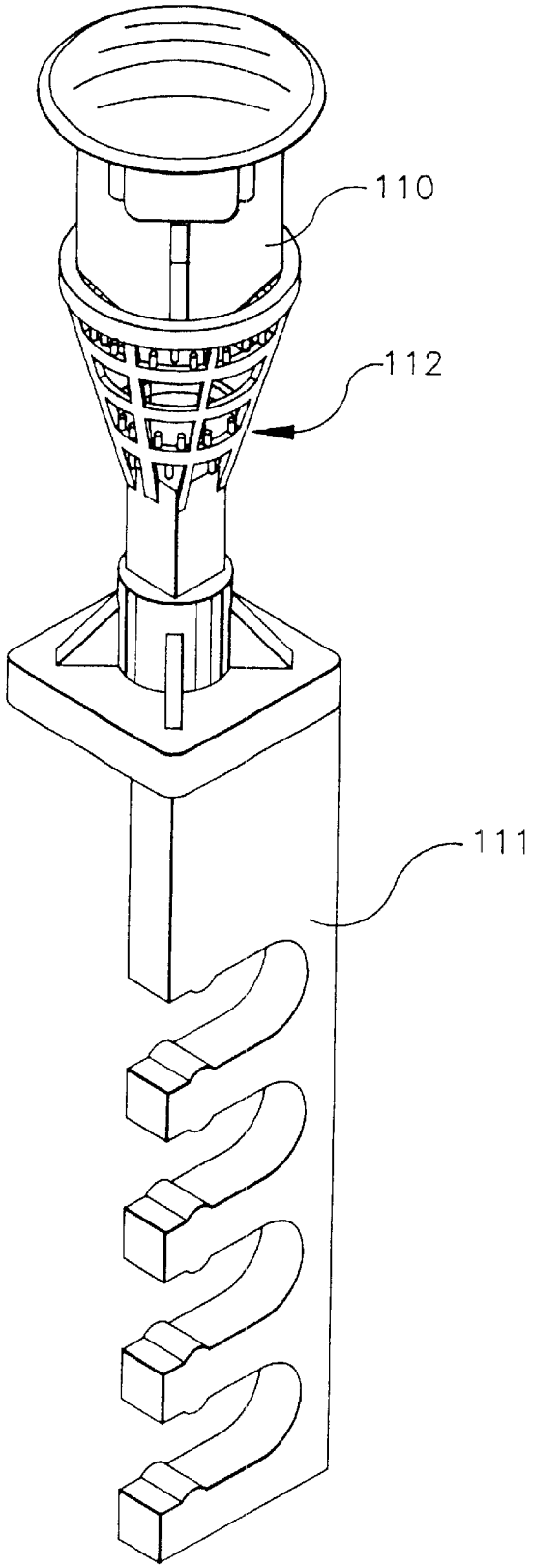
Figure 5E:
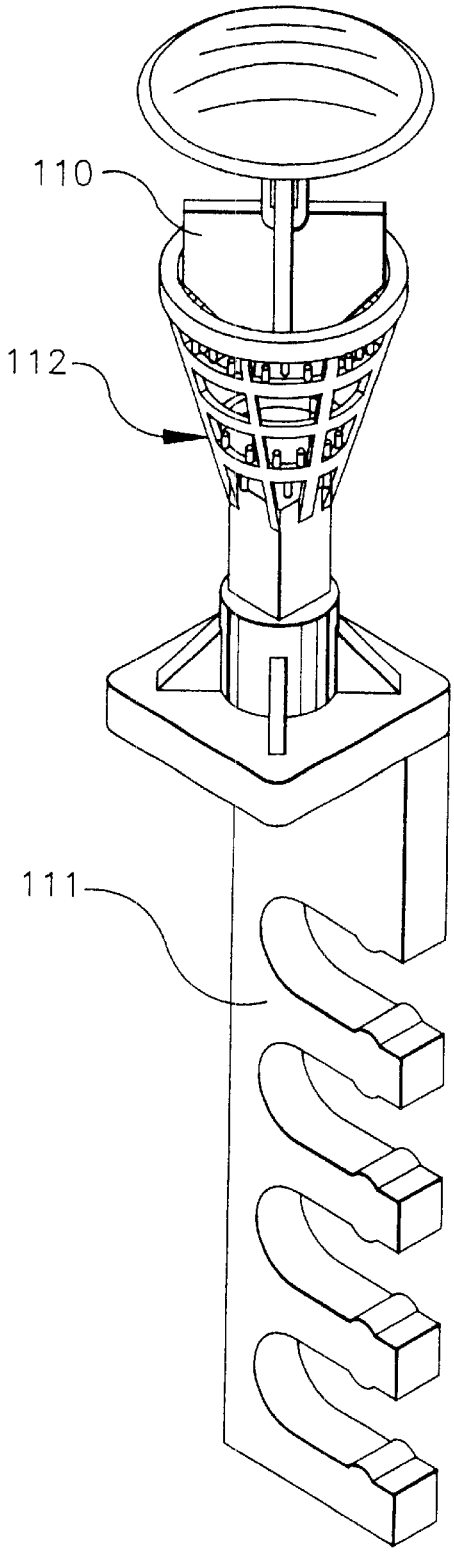
Figure 6A:
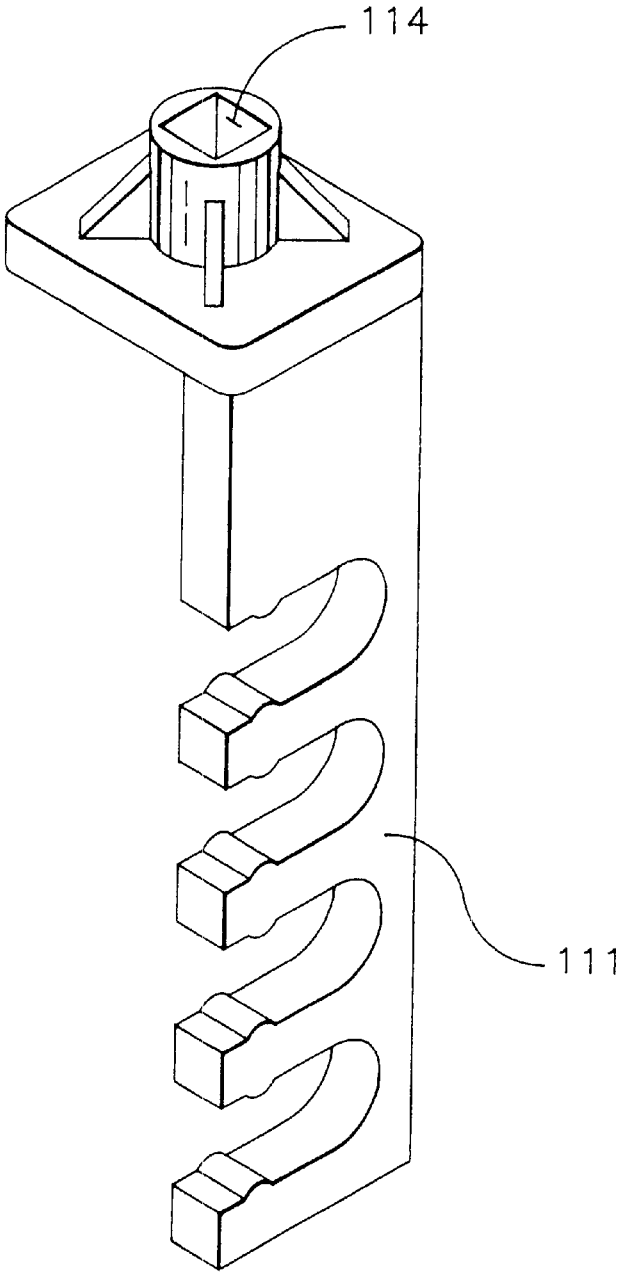
FIG. 6 is a blueprint drawing of the lower portion of the lavatory pop-up.
Figure 6B:
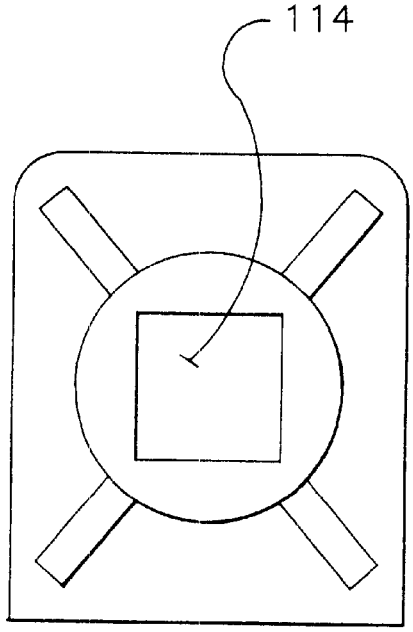

The invention also includes an embodiment called a pop-up trap, as shown in FIG. 4, FIG. 5, and FIG. 6. The invention includes a new pop up for drains 110, 111 to be used with the pop-up trap 112. The new pop-up is in two solid pieces, an upper section 110 and a lower section 111. The upper section is similar to existing pop-up hardware for sinks with the addition of two adjusting stabilizers 113 at the bottom of the upper section. These flanges are inserted into the opening at one end of the lower section 111 at the connection hole 114. The distinctive shape of the lower section allows it to be installed in a sink compatibly with existing sink hardware. The pop-up trap 112 is essentially the same as the tub trap, but sized to fit over the pop-up upper section and the loops can be either concentric circles like the shower trap or a single helical loop, as shown in.

Figure 7C:
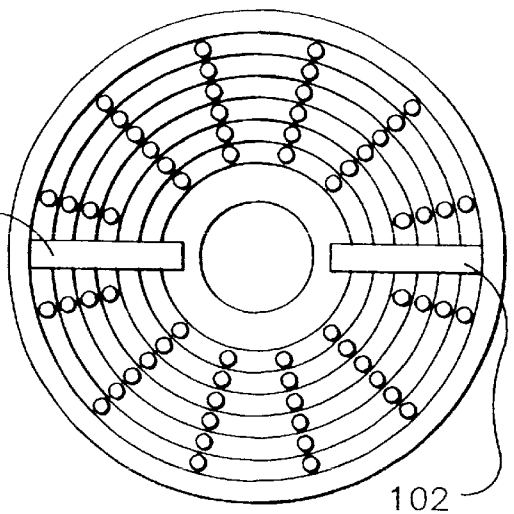
FIG. 7 is a blueprint drawing of the salon trap embodiment.
Figure 7B:
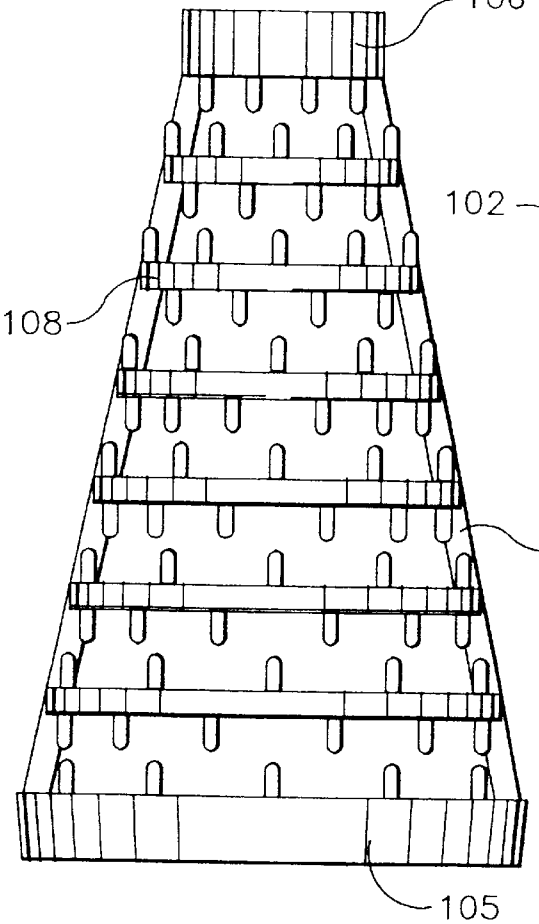
Figure 7A:
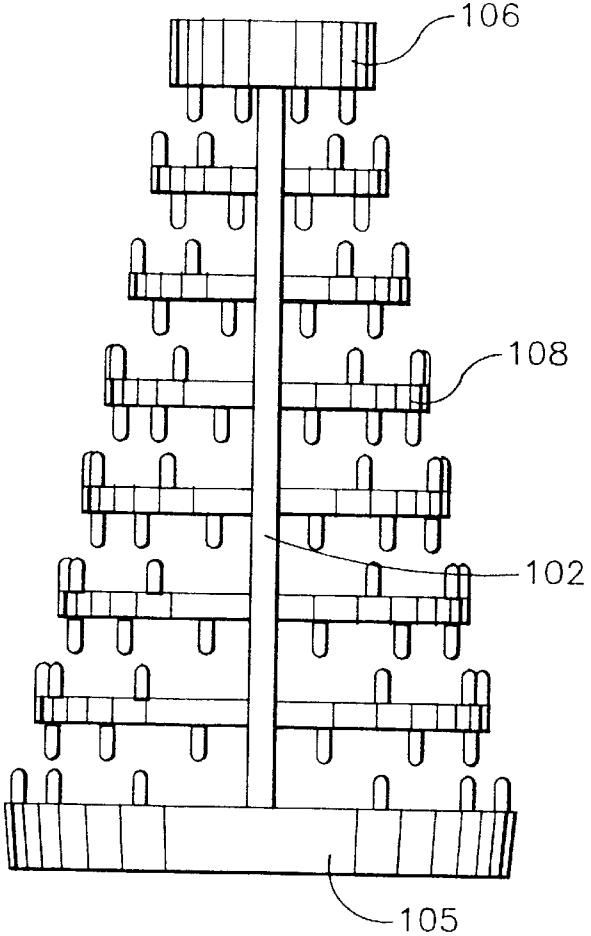
Figure 8A:
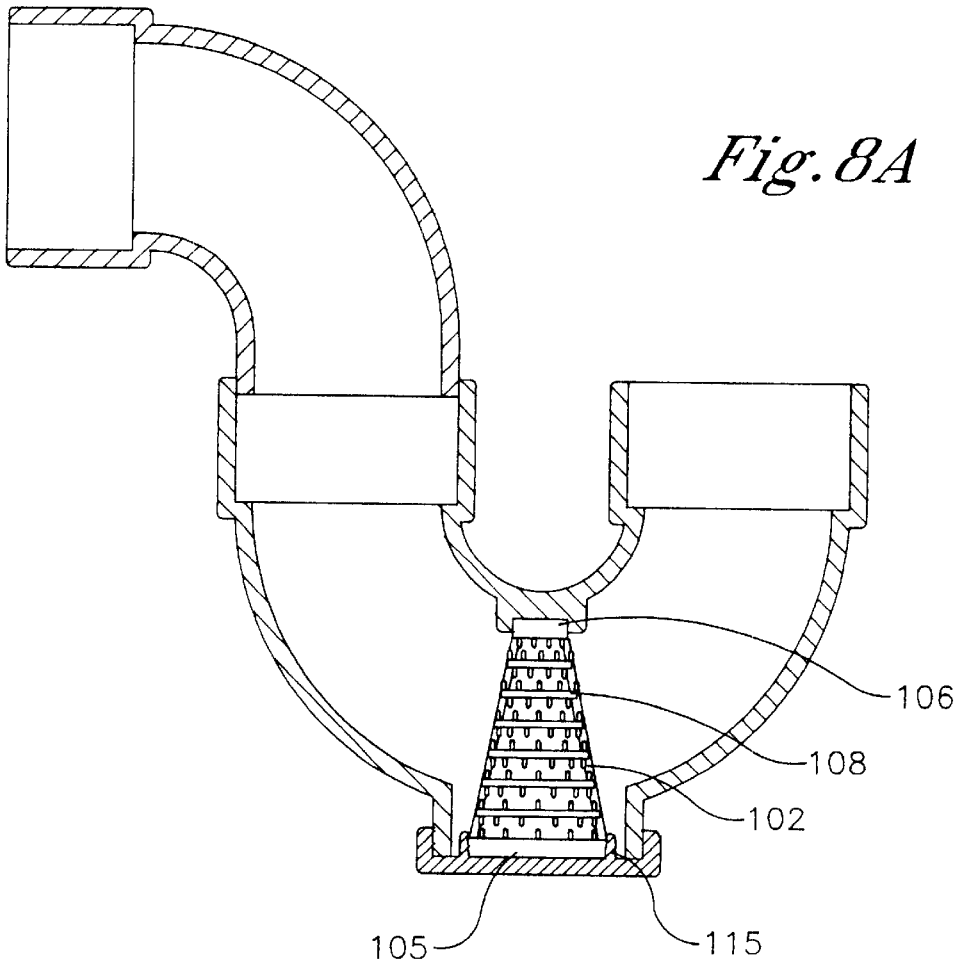
FIG. 8 is a blueprint drawing of the salon trap embodiment as it is placed in the sink trap location.
Figure 8B:
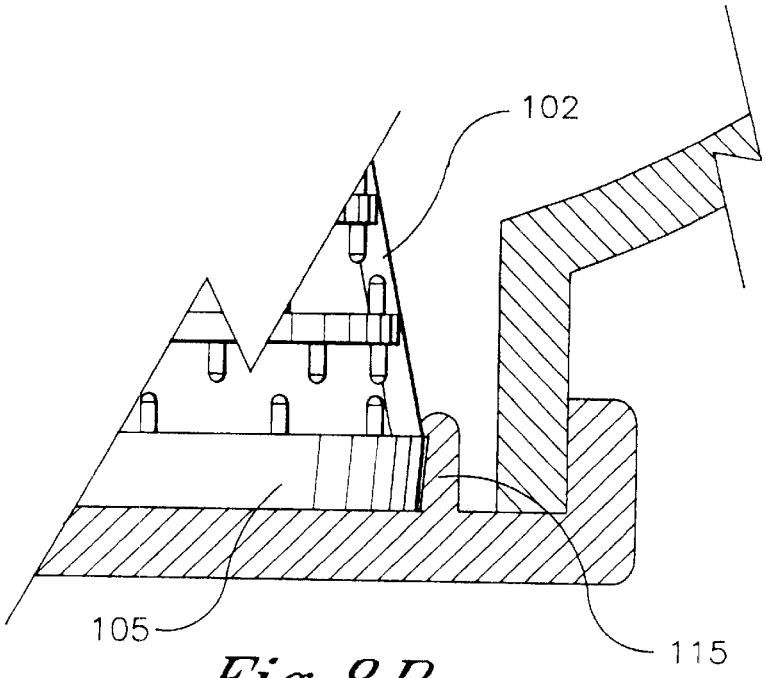

The invention also includes an embodiment called a salon trap, as shown in FIG. 7 and FIG. 8. The salon trap is a taller, narrower version of the tub trap with an additional adjusting stabilizer 115 shaped as shown in FIG. 8 Detail C.

What is claimed is:

1. A hair and fibrous shower trap comprising a material trapping system loop structure, said loop structure comprised of multiple, concentric circles fixedly attached to each other, said loop structure with a large opening at one end and a smaller opening at the other, said large opening fixedly attached to a top opening frame, said top opening frame in a circular shape, said smaller opening fixedly attached to a bottom opening frame, said top opening frame and said bottom opening frame fixedly attached to a first support strut and a second support strut, said first support strut running from the edge of said top opening frame to the edge of said bottom opening frame, said second support strut running from said top support frame at a point diametrically opposed to the connection point between said first support strut and said top opening frame to a diametrically opposed point on said bottom opening frame, said first support strut and said second support strut connected fixedly to said loop structure at a plurality of points on said loop structure, said loop structure possessing a rectangular cross section, said loop structure possessing a rough surface texture, said loop structure possessing a plurality of bullet-shaped barbs, said bullet-shaped barbs attached fixedly to the surface of said loop structure.

2. The shower trap of claim 1 where said top opening frame possesses four adjusting stabilizers, each of said adjusting stabilizers fixedly attached to the outer edge of said top opening frame in such a manner as to facilitate installation in a bathtub drain.

3. The shower trap of claim 1 where said top opening frame is shaped in such a manner as to fit within the screw-on opening to a sink trap, said top opening frame possessing adjusting stabilizers shaped to screw into said screw-on opening of said sink trap.

4. The shower trap of claim 1 where said shower trap is shaped so as to fit around a sink pop-up upper section and above a sink pop-up lower section, said sink pop-up upper section the same size and shape as standard sink pop-up hardware, said sink pop-up upper section possessing a pair of adjusting stabilizers at its lower end, said adjusting stabilizers shaped to be inserted into a top opening of said sink pop-up lower section, said sink pop-up lower section shaped so that it can be attached to existing sink hardware.

5. The shower trap of claim 1 where the entire device is constructed from rigid plastic.

6. The shower trap of claim 4 where the entire device is constructed from rigid plastic, where the pop-up upper section is constructed from metal, and where the pop-up lower section is constructed from plastic.

* * * * *